US006158853A

United States Patent [19]

Olsen et al.

[11] Patent Number: 6,158,853

[45] Date of Patent: Dec. 12, 2000

[54] INK CONTAINMENT SYSTEM INCLUDING A PLURAL-WALLED BAG FORMED OF INNER AND OUTER FILM LAYERS

[75] Inventors: David Olsen; Edward Z. Cai, both of Corvallis, Oreg.

[73] Assignee: Hewlett-Packard Company, Palo Alto, Calif.

[21] Appl. No.: 08/869,446

[22] Filed: Jun. 5, 1997

[51] Int. Cl.[7] ..... B41J 2/175

[52] U.S. Cl. ..... 347/86

[58] Field of Search ..... 347/85, 86, 87; 215/12.1; 220/495.05, 495.06, 62.18, 62.21, 62.22; 383/109, 111, 119

[56] References Cited

U.S. PATENT DOCUMENTS

| | | | |
|---|---|---|---|
| 4,172,152 | 10/1979 | Carlisle | 426/127 |
| 4,415,886 | 11/1983 | Kyogoku et al. | 340/618 |
| 4,429,320 | 1/1984 | Hattori | 347/86 |
| 4,447,820 | 5/1984 | Terasawa | 347/86 |
| 4,558,326 | 12/1985 | Kimura et al. | 347/30 |
| 4,568,954 | 2/1986 | Rosback | 347/86 |
| 4,831,389 | 5/1989 | Chan | 347/86 |
| 4,849,773 | 7/1989 | Owatari | 347/100 |
| 4,977,413 | 12/1990 | Yamanaka et al. | 347/7 |
| 5,126,767 | 6/1992 | Asai | 347/86 |
| 5,187,498 | 2/1993 | Burger | 347/86 |
| 5,221,935 | 6/1993 | Uzita | 347/36 |
| 5,305,920 | 4/1994 | Reiboldt et al. | 222/95 |
| 5,307,091 | 4/1994 | DeCoste, Jr. | 347/86 |
| 5,435,452 | 7/1995 | Nishigami et al. | 215/12.1 |
| 5,450,112 | 9/1995 | Scheffelin | 347/87 |
| 5,488,401 | 1/1996 | Mochizuki et al. | 347/86 |
| 5,500,663 | 3/1996 | Ujita et al. | 347/86 |
| 5,504,511 | 4/1996 | Nakajima et al. | 347/86 |
| 5,519,425 | 5/1996 | Dietl et al. | 347/87 |
| 5,523,780 | 6/1996 | Hirosawa et al. | 347/86 |
| 5,546,108 | 8/1996 | Hotomi et al. | 347/55 |
| 5,555,007 | 9/1996 | Ceschin et al. | 347/87 |
| 5,881,883 | 3/1999 | Siegelman | 206/720 |

FOREIGN PATENT DOCUMENTS

| | | | |
|---|---|---|---|
| 0561081A2 | 9/1993 | European Pat. Off. | B41J 2/175 |
| 0715958A2 | 6/1996 | European Pat. Off. | B41J 2/175 |
| 2485991 | 1/1982 | France | B41J 27/00 |
| 2103999A | 3/1983 | United Kingdom | B32B 27/06 |
| 2113180 | 8/1983 | United Kingdom | B65D 30/08 |
| 2103999B | 9/1985 | United Kingdom | B32B 27/06 |

OTHER PUBLICATIONS

Dulin, "Metallized films for food packaging", Jun. 1978, pp. 43–46, 53–55.

Kline, "Permeability of polymers to gases, vapors, and liquids", Mar. 1966, pp. 139–144, 150, 200–205, 210–213.

Aimcal, "Aimcal presents Metallizing's Best", Mar. 1985, pp. 51–53.

*Primary Examiner*—N. Le
*Assistant Examiner*—Michael Nghiem

[57] ABSTRACT

The invented containment system provides a double-walled, or nested bag, configuration in which ink or liquid toner is contained within the sealed inner bag and the inner bag is contained, in turn, within a sealed outer bag. An inlet/outlet port is provided for the introduction and extraction of ink into and out of the interior volume formed by the nested bags. In one embodiment, the sidewalls are formed separately and their peripheral edges are staked to either side of an annular frame member formed integrally with the inlet/outlet port. In another embodiment, the sidewalls are sealingly joined directly to one another along their peripheries. Preferably, the inner bag or liner is a flexible mono polymer film or co-extrusion thereof that is ink-impermeable and the outer bag or liner is a flexible laminar structure including metallized polymer layers adhered to one another.

16 Claims, 2 Drawing Sheets

INK CONTAINMENT SYSTEM INCLUDING A PLURAL-WALLED BAG FORMED OF INNER AND OUTER FILM LAYERS

TECHNICAL FIELD

The present invention relates generally to ink containment systems for printers. More particularly, it concerns an improved ink containment system wherein a plural-walled ink-containing bag is formed of two opposing walls each of which is formed of separate, inner and outer, film layers joined along their peripheries and joinable to an inlet/outlet port or fitment.

BACKGROUND ART

Typically, ink-containment systems for printers must provide for the secure containment of ink and for the introduction of ink thereinto and extraction of ink therefrom. Traditional constructions have been rigid, e.g. collapsible-rigid-wall structures, or compliant, e.g. collapsible-flexible-single-wall, structures of the so-called pillow design whereby opposing laminar sidewalls are joined along their peripheries to render a pillow-shaped ink container. Some of the drawbacks of such conventional ink-containment systems is volumetric inefficiency of the containment or the extraction whereby only a fraction of the containers nominal volume, e.g. only approximately 60%, is usable for containment and/or a significant volume of remnant ink is discarded with the container after maximum extraction.

Another problem with laminar sidewall structures is that ink containment typically requires a metallization of the laminates, which sometimes leads to delamination due to ink or other harsh liquid contamination. The drawback to metallization in laminates is low adhesion to the adhesives used to bond the films, and susceptibility to ink and liquid toner attack. Thus, while metallization meets the requirements of strength and ink-, air- and gas-impermeability, it reduces the reliability of the containment. Laminar structures in general notoriously delaminate due to flexure and/or ink contamination. Once a sidewall structure has begun the delamination process, the process is irrevocably progressive. Further, laminar sidewall structures of a given thickness are inherently less flexible, simply because of the bonding of the laminar components over their substantial surface area, than two separate films of the same overall thickness. Thus, a single film used for ink or liquid toner containment, whether laminated or not, which has the same overall thickness tends to be stiffer and thus less efficient.

Ink containers preferably resist leakage not only in normal use, but also when accidentally dropped. Rigid box-like containment structures tend to shatter or fracture when dropped, and flexible, single-walled, pouch-like containment structures tend to burst or puncture when dropped. None of the known prior art ink-containment structures provides for the secure containment of ink against the possibility of ink leakage during long-term storage, normal use or accidental shock or other trauma to the container.

DISCLOSURE OF THE INVENTION

Briefly, the invented containment system provides a double-walled, or nested bag, configuration in which ink or liquid toner is contained within the sealed inner film and the inner film is contained, in turn, within a sealed outer film. An inlet/outlet port is provided for the introduction and extraction of ink into and out of the interior volume formed by the nested bags. In one embodiment, the sidewalls are formed separately and their peripheral edges are staked to either side of an annular frame member formed integrally with the inlet/outlet port. In another embodiment, the sidewalls are sealingly joined directly to one another along their peripheries. Preferably, the inner bag or liner is a flexible mono polymer film or coextrusion thereof that is ink-impermeable and the outer bag or liner is a flexible laminar structure including metallized polymer layers adhered to one another.

These and additional objects and advantages of the present invention will be more readily understood after consideration of the drawings and the detailed description of the preferred embodiment which follows.

DETAILED DESCRIPTION OF THE PREFERRED EMBODIMENTS AND BEST MODE OF CARRYING OUT THE INVENTION

In accordance with conventional ink-containment devices made with laminar sidewall construction, plural layers of different materials—each performing typically only one needed function, e.g. sealing, metallizing, strengthening or adhering—form a bonded film or sheet. Problems alluded to in the background section hereof include that of delamination and insufficient flexibility in such an ink-containment devices. Those of skill in the art will appreciate that metallization layers tend to form relatively weak bonds with other layers. Moreover, ink and liquid toner tend to attack rather harshly such layers, the result of which often is undesirable delamination over time. It will also be appreciated that the flexural modulus of a bonded, laminar structure is lower simply because of the nature of a laminate in which, over any arbitrarily short, longitudinal span of the laminate, there is less capacity of the laminate to flex or bend due to the inter-layer bonding of plural laminar components therein.

Figure 2:
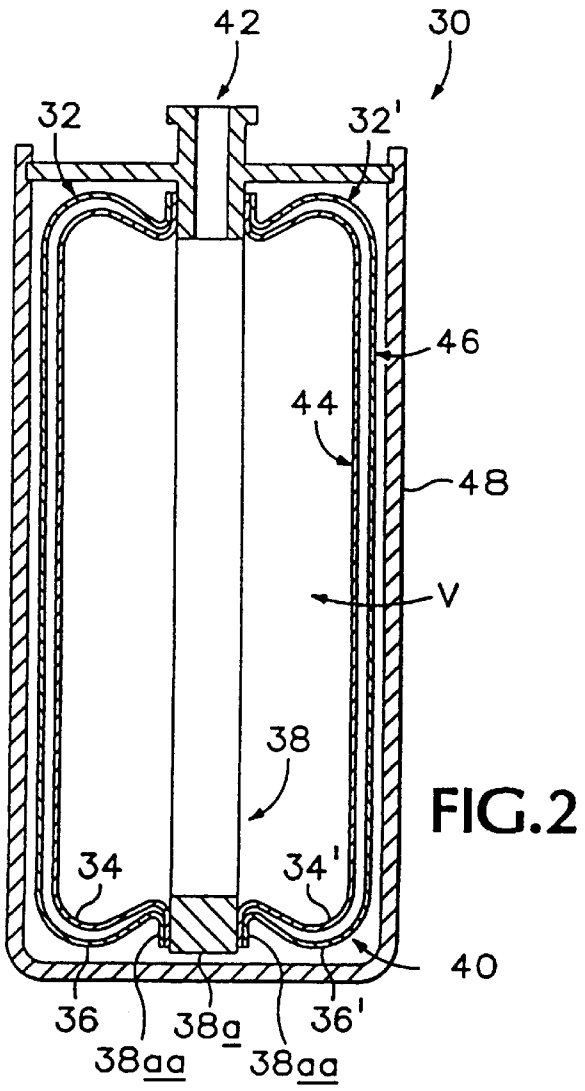
FIG. 2 is a cross-sectional view of the invented system, taken generally along the lines 2—2 of FIG. 1.
Figure 1:
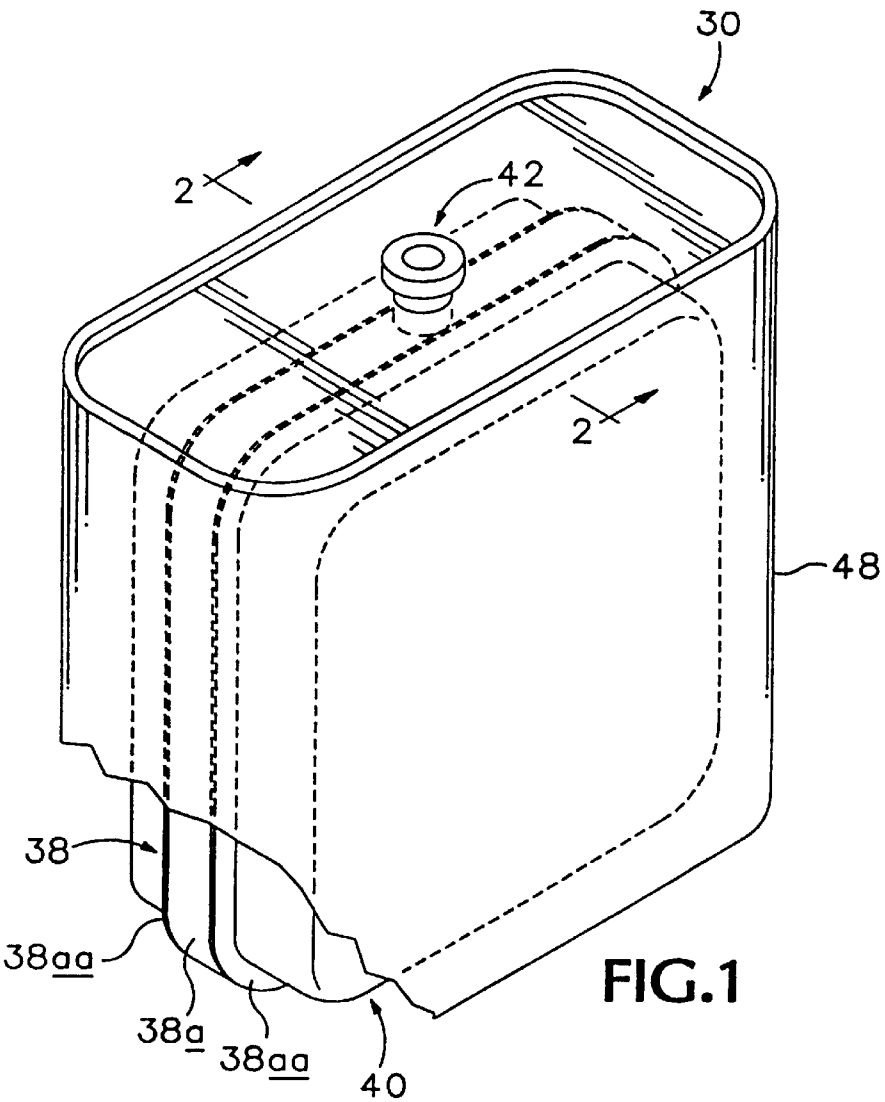
FIG. 1 is a fragmentary, isometric view of the invented ink-containment system made in accordance with a preferred embodiment.

Referring collectively to FIGS. 1 and 2, the invented ink- or liquid toner-containment system is indicated generally at 30. Importantly, it may be seen that system 30 in accordance with a first preferred embodiment includes opposing sidewalls 32, 32', each including a generally coextensive inner layer and a separate outer layer, the sidewalls defining an ink- or toner-containment volume V. Thus, immediately it may be appreciated that the prior art laminar sidewall structure having the problems discussed above is avoided in accordance with invention. Preferably, sidewall 32 includes an inner layer 34 and an outer layer 36 preferably approximately coextensive therewith, with the peripheral edges of layers 34, 36 sealingly joined together. Similarly, sidewall 32' preferably includes an inner layer 34' and an outer layer 36' approximately coextensive therewith, similarly sealingly joined with one another. It will be appreciated that primed reference designators, e.g. 32', associated with unprimed reference designators, e.g. 32, as used herein, indicate opposing, and usually mirror-image, but otherwise identical components of systems 30, 130 (see FIGS. 3, 4).

As may be seen, a frame chassis member or armature 38 including a rectilinear annulus indicated generally at 38*a* bonds opposing sidewalls 32, 32' along opposing, raised, annular shoulders 38*aa,* thereby to complete a pocket-like enclosure or container 40 for the leak- and rupture-proof containment of ink or liquid toner. As will be seen, an alternative embodiment of the invented system includes no frame chassis armature 38, but instead effectively, directly joins opposing sidewalls 32, 32' at their peripheries, thereby to form a relatively free-standing, sealed pouch-like container 130 for corrosive or otherwise harsh printer liquid, e.g. for the containment of an inkjet printer's ink or a laser printer's liquid toner.

Referring still to FIGS. 1 and 2, it may be seen that system 30 preferably also includes an inlet/outlet port 42, which may be integral with frame chassis armature 38, as indicated in the illustrated embodiment, or may be separate therefrom. Inlet/outlet port 42 will be understood to assume any desired configuration, within the spirit and scope of the invention, and its purpose of course will be understood to be to permit introduction of ink or liquid toner into, and to permit extraction of ink or liquid toner from within sealed container 40. It will be apparent that opposing double-walled sidewalls 32, 32' form what will be referred to herein as nested, inner and outer bags 44, 46. Ink or liquid toner may be introduced into or extracted from plural-bag containment system 30 in any suitable manner, as by the use of syringes, pumps, etc. A preferably removable, rigid outer shell 48 of any desired configuration may be provided for purposes of handling, etc.

It may be seen perhaps better from FIG. 2 that the front side film layers have been staked along annulus 38 partly to define a double-walled bladder for the containment of ink or liquid toner. Between the inner and outer film layers that define this front sidewall is a 1 atmosphere volume of air that acts as a shock absorber to reduce the possibility of rupturing the inner film layer that contains ink or liquid toner. It is believed that this double-walled construction provides an unprecedented level of security and reliability in ink or fluid toner containment. The invented system may be thought of as a redundant system, as its bag-in-bag structure provides two nested containment vessels so that if the inner bag should rupture, nevertheless the outer bag will still contain the ink or liquid toner.

Figure 4:
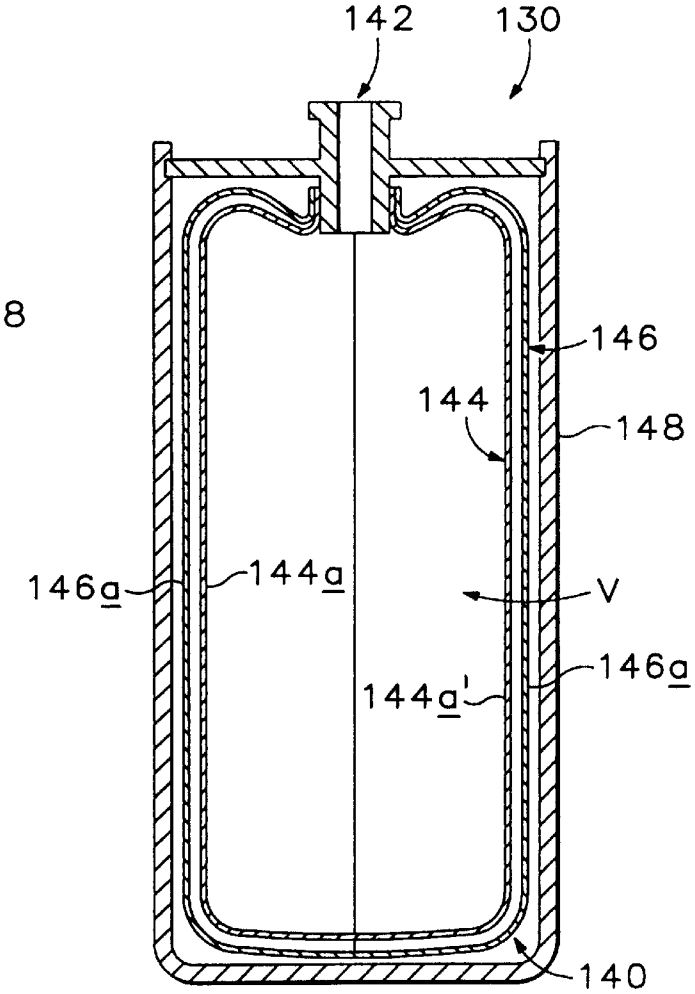
FIG. 4 is a cross-sectional view of the invented system in its alternative embodiment, taken generally along the lines 4—4 of FIG. 3.
Figure 3:
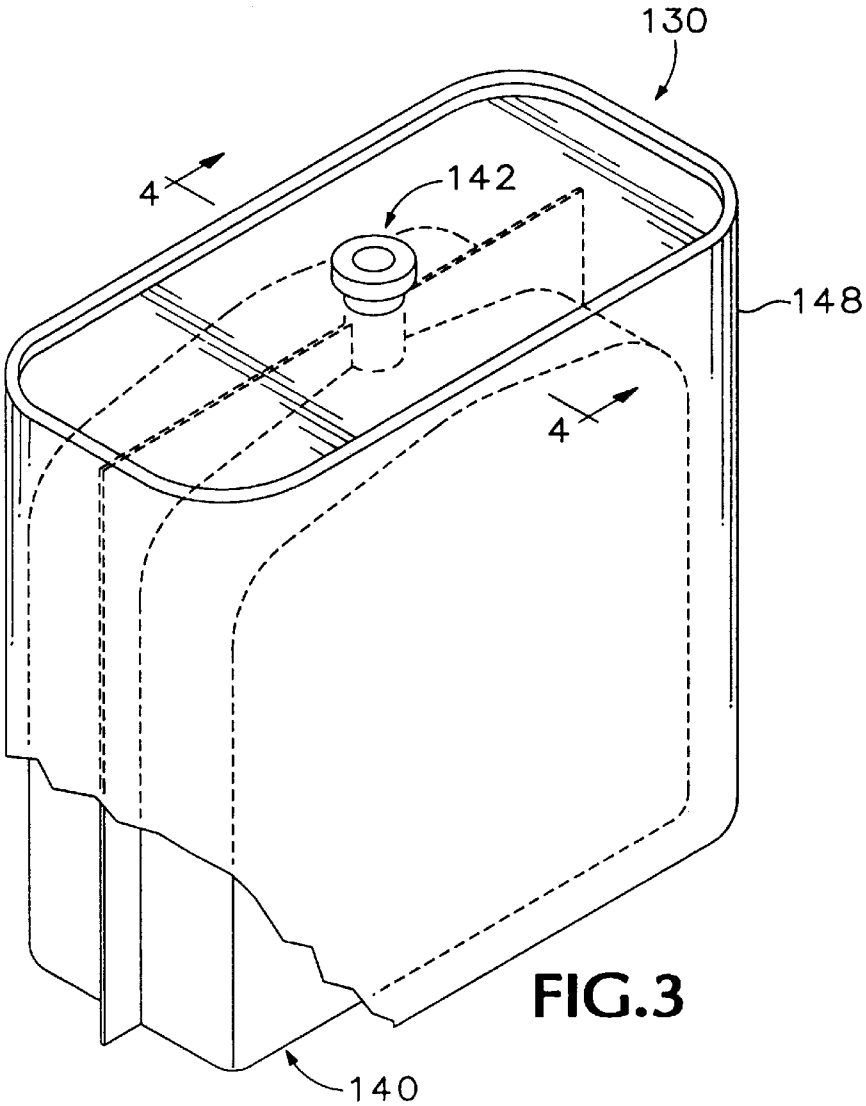
FIG. 3 is a fragmentary, isometric view of the invented ink-containment system made in accordance with an alternative, preferred embodiment in which there is provided no chassis frame connection.

Turning now collectively to FIGS. 3 and 4, an alternative preferred embodiment of the invention is indicated generally at 130. Ink- or liquid toner-containment system 130 may be seen to differ from system 30 in only one important respect: system 130 has no annulus or ring to which the sidewalls attach. Instead, in accordance with the alternative embodiment of the invention, the sidewalls are joined around their peripheral edges, or selvages, directly to one another. An inlet/outlet port 142 is provided and a protective shell 140 may be provided in this embodiment, within the spirit and scope of the invention. It will be appreciated that the pleats by which bag-in-bag system 130 tends to maintain its rectilinear shape preferably are in the base region, and thus are invisible.

The invention may be described as a fluid-containment system. The invented system 130 in accordance with its preferred embodiment includes a first inner bag 144 including opposing generally coextensive flexible films 144*a,* 144*a'* of fluid-impervious material defining a fluid-containment volume V therebetween; a second outer bag 146 substantially enclosing first inner bag 144 in a nested configuration—to produce a double-walled containment of ink or liquid toner—with outer bag 146 including opposing generally coextensive films 146*a,* 146*a'* of impact-resistant material; and an inlet/outlet port structure 142 connected with a periphery of nested first and second bags 144, 146 for introduction of fluid into, and extraction of fluid out of fluid-containment volume V. Preferably, the invented system further includes a mounting structure connected with the port structure, similar to that shown in FIGS. 1 and 2, for mounting such nested first and second bags and port structure to the frame member of the printer. Although, as may be seen from FIGS. 3 and 4, this feature is optional and a containment system without such mounting structure is within the spirit and scope of the invention. System 130 also may provide a protective outer shell 148.

Preferably, the first bag includes an overlapped first selvage substantially defining its periphery, with the first selvage including a first joining structure that joins the layers of fluid-impervious material in opposition to form the inner bag. Similarly, the second bag includes an overlapped second selvage substantially defining its periphery, with the second selvage including a second joining structure that joins the layers of air-impervious material in opposition to form the outer bag. Such is better seen in FIGS. 1 and 2, as in accordance with the alternative embodiment described above. The inner and outer bags each are formed of single continuous sheets of material.

It will be appreciated that selvage is used herein in its broadest sense to refer to a peripheral edge of a material layer, e.g. a film or layer, for joining with a peripheral edge of another material layer. In accordance with a preferred embodiment of the invention, corresponding and lapping peripheral edges, or selvages, of opposing inner layers and overlapping outer layers that form the double-walled bag are suitably bonded to produce a sealed periphery of the bag for leak-proof and impact-resistant containment of a printer's ink or liquid toner.

Preferably, the first joining structure includes a rigid annular structure interposing opposed flexible layers, as shown in FIGS. 1 and 2. Opposed layers of the fluid-impervious material may be formed from a single folded or otherwise formed, e.g. vacuum molded, sheet of the material. Similarly, opposed layers of impact-resistant material may be formed from a single folded or otherwise formed, e.g. vacuum molded, sheet of the material. The opposing flexible layers may be staked, or otherwise sealingly joined to the annular structure by any suitable means involving elevated temperature and pressure, and may be staked one at a time or at the same time.

It will be appreciated that the material from which is formed what will is referred to herein as inner bag 44, 144 must have the following properties: provides effective moisture-barrier, provides enough strength to resist rupture, flexible enough to stretch without breaking, and able to seal to high-density polyethylene (HDPE), the latter material being that from which the armature, fitment and inlet/outlet port preferably are made. Thus, in accordance with a preferred embodiment of the invention, the fluid-impervious material is chosen from a group including (1) low-density, linear low-density or ultra-low-density or single-site catalyst polyethylene (LDPE, LLDPE, ULDPE or SSCPE) or (2) co-extrusions thereof with core materials of bi-axially oriented nylon (BON) or ethyl vinyl alcohol (EVOH), e.g. co-extruded LLDPE/BON/LLDPE or LLPDE/EVOH/LLDPE, or polyvinylidene fluoride (PVDF). Such mono or co-extruded films as are used to form what will be referred to herein as the inner bag preferably are between approximately 1 and 3 mils thick.

It will be appreciated that the material from which is formed what will be referred to herein as outer bag 46, 146 must exhibit the following properties: provide a moisture and air barrier, add strength further to resist rupture and to protect the inner bag, act as a redundant seal in case the inner bag breaks, and capable of sealing to HDPE and to the inner bag. Thus, also in accordance with a preferred embodiment of the invention, the impact-resistant material is a polymers/thin-metals laminate of bonded layers wherein the polymers are chosen from a group including preferably linear (the linear orientation will be understood positively to affect impact strength), low-density polyethylene (LLDPE), polyester (PET), BON and oriented polypropylene (OPP), and wherein the metals are chosen from a group including aluminum (Al) and silver (Ag). One such workable laminar structure (from innermost to outermost laminate) is LLDPE/PET-MET/MET-PET/LLDPE. Another (also from innermost to outermost laminate) is LLDPE/PET-NET/BON. Those skilled in the art will appreciate that the metallized polyester layers are preferably formed by vapor or sputter deposition of metal particles onto thin films of polyester, and that such metallized polyester layers act as excellent barriers to air and moisture. The layers of the laminar structure that form the outer films of the sidewalls may be bonded by any suitable adhesive.

As may be seen in FIGS. 3 and 4, the first and second bags 144, 146 preferably are configured at least in a base region thereof as a generally right parallelepiped, wherein the right parallelepiped configuration is nominally maintained at least in part by one or more pleats formed in the base region of the nested bags. Other pleating arrangements and configurations are contemplated, as are alternative methods of forming approximately right angles and comers, etc. in the double-walled bladder, and all are within the spirit and scope of the invention.

Another way of understanding the invention is to think of it more simply as an ink- or liquid toner-containment system that includes, in accordance with a preferred embodiment thereof, a rigid armature including an annulus that defines an aperture and further including an inlet/outlet port; a first sidewall including an inner and an outer film joined on its periphery to a first side of the armature along the annulus, thereby to bound the aperture on a first side of the armature; and a second sidewall including an inner and an outer film joined on its periphery to a second side of the armature along the annulus, thereby to bound the aperture on a second side of the armature.

It may be seen, then, that the first and second sidewalls and the annulus define a fluid-containment bladder having a predefined maximum internal volume V between the first and second sidewalls and within the aperture. It will also be appreciated that the choice of materials for the inner and outer films render the inner films flexible and substantially impervious to penetration by ink or liquid toner, and render the outer films flexible and substantially impervious to penetration by air or moisture. As described and illustrated herein, while the invented containment system is for use with a printer having a frame member, it preferably further includes mounting structure connected with the armature for mounting the armature to the frame member. In either embodiment, it will be appreciated that plural (e.g., two or more) nested bags may provide for redundant fluid contaminant.

INDUSTRIAL APPLICABILITY

It may be seen, then, that the invented system has broad applicability in connection with ink- or liquid-toner-containment, and has more particular applicability to ink-jet or laser printers having replaceable ink supplies. Ink-containment systems made in accordance with the preferred embodiment of the invention have proven themselves reliably and securely to contain ink or liquid toner for extended periods of time, and have even survived a drop from an airplane. They also have been proven to yield more than approximately 90% of the ink contained therein, thus greatly increasing containment and extraction efficiency and reducing waste. Yet the invented system is inexpensively manufactured, e.g. by vacuum and/or injection molding. It will be appreciated that the invented system for ink or liquid toner containment may be manufactured using existing tools, dies and assembly processes and equipment.

Accordingly, while the present invention has been shown and described with reference to the foregoing preferred embodiments, it will be apparent to those skilled in the art that other changes in form and detail may be made therein without departing from the spirit and scope of the invention as defined in the appended claims.

I claim:

1. A fluid-containment system for a printer having a frame member, the system comprising:

a first, inner bag formed from flexible, chemical resistant, substantially-fluid-impermeable material defining a fluid containment volume therein;

a second, outer bag spaced apart from said inner bag and substantially enclosing said inner bag in a nested configuration that allows movement of said inner bag relative to said outer bad, said outer bag formed from a flexible, substantially-air-impermeable material;

a rigid outer shell enclosing said inner and outer bags in a nested confirmation to provide a structure for handling the fluid containment system; and an inlet/outlet port structure connected with a periphery of said nested inner and outer bags for the introduction of fluid into an out of said fluid-containment volume.

2. The system of claim 1 wherein said inner bag is formed of unlaminated plural films.

3. The system of claim 1 wherein said outer bag is formed of laminated, plural films.

4. An ink/toner containment system for a printer having a frame member, the system comprising:

a first, inner bag including opposing generally coextensive flexible films of fluid-impermeable material defining a fluid-containment volume therebetween;

a second, outer bag substantially enclosing said first inner bag in a nested configuration, said outer bag including opposing generally coextensive flexible films of air-impermeable material, wherein said substantially-air-impermeable material is a polymers/thin-metals laminate of bonded layers;

a rigid outer shell enclosing said inner and outer bags in a nested configuration to provide a structure for handling the fluid containment system; and an inlet/outlet port structure connected with a periphery of said nested inner and outer bags and of said outer shell for the introduction of fluid into and out of said fluid-containment volume.

5. The system of claim 4, wherein said inner bag includes an overlapped first selvage substantially defining its periphery, said first selvage including a first joining structure that joins said films of fluid-impermeable material in opposition to form said inner bag.

6. The system of claim 4, wherein said outer bag includes an overlapped second selvage substantially defining its periphery, said second selvage including a second joining structure that joins said films of air-impermeable material in opposition to form said outer bag.

7. The system of claim 6, wherein said first joining structure includes a rigid annular structure interposing said opposing flexible films of said inner and outer bags.

8. The system of claim 4, wherein said opposing films of fluid-impermeable material are formed from a single formed sheet of said material.

9. The system of claim 4, wherein said opposing films of air-impermeable material are formed from a single formed sheet of said material.

10. The system of claim 4, wherein said fluid-impermeable material is chosen from a group including low-density polyethylene or co-extrusions thereof and polyvinylidene fluoride.

11. The system of claim 4, wherein the polymers are chosen from a group including low-density polyethylene, polyester and nylon, and wherein the metals are chosen form a group including aluminum and silver.

12. The system of claim 11, wherein said bonded layers are bonded to one another by an adhesive.

13. An ink- or liquid toner-containment system comprising:

a rigid armature including an annulus that defines an aperture and further including an inlet/outlet port;

a first sidewall including normally spaced-apart inner and outer films defining a contained air volume therebetween, said first sidewall being sealingly joined on its periphery to a first side of said armature along said annulus, thereby to bound said aperture on a first side of said armature; and a second sidewall including normally spaced-apart inner and outer films defining a contained air volume therebetween, said second sidewall being sealingly joined on its periphery to a second side of said armature along said annulus, thereby to bound said aperture on a second side of said armature, said first and said second sidewalls and said annulus defining a fluid-containment bladder having a predefined maximum internal volume between said first and said second sidewalls and within said aperture, wherein said inner films are flexible and substantially impervious to penetration by ink or liquid toner and wherein said outer films are flexible and substantially impervious to penetration by air or moisture therein.

14. The system of claim 13 wherein said inner and outer films are bonded to one another along their periphery proximate said annulus of said armature.

15. The system of claim 13 wherein said inner films are formed of a material chosen from the group including low-density polyethylene or co-extrusions thereof and polyvinylidene fluoride.

16. The system of claim 13 wherein said outer films are formed of a material including a polymers/thin-metals laminate of bonded layers wherein the polymers are chosen from a group including low-density polyethylene, polyester and nylon, and wherein the metals are chosen from a group including aluminum and silver.

* * * * *